United States Patent [19]

Lee et al.

[11] Patent Number: 4,860,827

[45] Date of Patent: Aug. 29, 1989

[54] PROCESS AND DEVICE FOR OIL RECOVERY USING STEAM AND OXYGEN-CONTAINING GAS

[75] Inventors: Robert Lee, Montreal; Derek Hornsey, Beaconsfield; Guillermo Garrido, St. Bruno; José M. Diéguez, St. Bruno de Montarville, all of Canada

[73] Assignee: Canadian Liquid Air, Ltd., Montreal, Canada

[21] Appl. No.: 142,869

[22] Filed: Jan. 11, 1988

[30] Foreign Application Priority Data

Jan. 13, 1987 [CA] Canada ..... 527166

[51] Int. Cl.[4] ..... E21B 43/243

[52] U.S. Cl. ..... 166/261; 166/57; 166/272; 166/902

[58] Field of Search ..... 166/256, 261, 272, 260, 166/902, 251, 57, 59, 195

[56] References Cited

U.S. PATENT DOCUMENTS

| | | | |
|---|---|---|---|
| 2,125,231 | 7/1938 | Hurst | 166/195 |
| 3,369,604 | 2/1968 | Black et al. | 166/261 |
| 3,400,762 | 9/1968 | Peacock et al. | 166/272 X |
| 3,978,925 | 9/1976 | Redford | 166/261 |
| 4,042,026 | 8/1977 | Pusch et al. | 166/251 X |
| 4,048,078 | 9/1977 | Allen | 166/261 X |
| 4,114,690 | 9/1978 | Cram et al. | 166/261 |
| 4,136,739 | 1/1979 | Salathiel et al. | 166/300 |
| 4,223,735 | 9/1980 | Caldwell, Jr. et al. | 166/303 |
| 4,234,042 | 11/1980 | Kirkpatrick et al. | 166/251 X |
| 4,237,973 | 12/1980 | Todd | 166/59 |
| 4,418,751 | 12/1983 | Emery | 166/261 |
| 4,440,227 | 4/1984 | Holmes | 166/261 |
| 4,475,596 | 10/1984 | Papst | 166/303 |
| 4,498,537 | 2/1985 | Cook | 166/261 X |
| 4,509,595 | 4/1985 | Savard et al. | 166/261 |
| 4,512,403 | 4/1985 | Santangelo et al. | 166/57 X |
| 4,557,329 | 12/1985 | Savard et al. | 166/261 |
| 4,593,759 | 6/1986 | Penick | 166/261 |
| 4,683,947 | 8/1987 | Fernbacher et al. | 166/261 X |

FOREIGN PATENT DOCUMENTS 1220414 4/1987 Canada .

OTHER PUBLICATIONS

White, "Thermal Recovery in the 80's", Mar. 1986.

Fairfield and White, "Lloydminster Fireflood Performance, Modifications Promise Good Recoveries", Technology, Feb. 1982, Oil & Gas Journal.

Howard, "In Situ Combustion", Moving Heavy Oil Conference, Jun. 1982.

Chu, "State-of-the-Art Review of Steamflood Field Projects", JPT, Oct. 1985.

Meldau et al., "Cyclic Gas/Steam Stimulation of Heavy-Oil Wells", SPE of AIME, 1981.

*Primary Examiner*—Bruce M. Kisliuk

*Attorney, Agent, or Firm*—Lee C. Robinson, Jr.

[57] ABSTRACT

Oil is recovered from an underground formation by the use of steam and a gas rich in oxygen. In a priming stage, high quality saturated steam or superheated steam is injected into the formation to raise the reservoir temperature, in the vicinity of injection, to the combustion temperature of the oil. Then, in a combustion stage, the injection of steam is continued and oxygen-containing gas is injected as well, so that local combustion of oil occurs. This results in further heating of the steam and the generation of hot combustion gases, increasing the mobility of the oil and creating pressure drive. The priming and combustion stages may be part of a cyclic steam stimulation ("huff and puff") method or a steam flooding method. Special expedients are provided for the safe use of oxygen and steam.

11 Claims, 4 Drawing Sheets

PROCESS AND DEVICE FOR OIL RECOVERY USING STEAM AND OXYGEN-CONTAINING GAS

This invention relates to the thermal recovery of oil from underground formations. More particularly, it relates to a process of this nature in which steam and an oxygen-containing gas is injected into the formation.

The use of superheated steam for oil recovery was proposed at least as far back as 1939, in U.S. Pat. No. 2,1478,717, Whitney.

White (Tejas Petroleum Engineers, Inc.) in his paper "Thermal Recovery in the 80's", quotes from Mathney "Production Report", Oil and Gas Journal of Mar. 31, 1980, which notes the current production of oil by steam recovery at about 340,000 barrels a day. This recovery, White states, is centered in the heavy oil fields of California, with very little work currently being carried out in the higher gravity and heavier oil fields in the rest of the country. Presumably, White's comments are limited to the United States.

Fairfield (Husky) and White (Tejas) in their article "Lloydminster Fireflood Performance, Modifications Promise Good Recoveries" appearing in TECHNOLOGY, Feb. 8, 1982, Oil & Gas Journal, report that efforts to increase ultimate recovery of oil by thermal methods began in 1965 with steam huff and puff and displacement steam drive. These "early" efforts, they say, were not successful.

Howard, in an article entitled "In-Situ Combustion" presented at Enhanced Recovery Week's "Moving Heavy Oil Conference", June 7–8, 1982 in Los Angeles, Calif., discusses factors which have to be taken into consideration in thermal oil recovery and operating problems that are encountered.

Chieh Chu (Texaco Inc.) "State-of-the-Art Review of Steam-flood Field Projects", published in the October 1985 issue of the Journal of Petroleum Technology, discusses various operational problems of the steam flood process. Among these, the author mentions sanding, poor productivity in hot wells, emulsion formation, the production of acid gas and solids and mechanical features.

Meldau, Shipley and Coats, in an article "Cyclic Gas/Stream Stimulation of Heavy-Oil Wells", copyright 1981, Society of Petroleum Engineers of AIME, report that injecting air with steam nearly doubled oil production from three cyclic steam stimulations in a California reservoir producing 11° API (0.99 -g/cm$^3$) oil.

U.S. Pat. No. 3,457,995, Cornelius et al (1969) discloses a method of igniting an underground formation which comprises, first injecting steam to raise the temperature and pressure above the ignition temperature, with an auto-ignitable fuel at the pressure of the formation. Steam injection is terminated and an auto-ignitable fuel, which can be crude oil and mixtures of crude oil with tung oil, linseed oil and tall oil, are injected. The injection of the auto-ignitable fuel is then terminated, and air is injected to propagate the combustion of the auto-ignitable fuel.

The publications mentioned are hereby incorporated by reference.

It is an aim of the present invention to provide a steam recovery process which lacks disadvantages of prior processes and provides positive advantages, as will be apparent from the disclosure to follow.

The applicants have found that surprising results, in terms of oil recovery and economy, can be achieved in cyclic or steam flooding processes by injecting a gas containing a high proportion of oxygen along with saturated or superheated steam into an oil bearing formation in a combustion stage.

In accordance with the invention, saturated or superheated steam is injected into the formation in a priming stage, to bring the temperature in the region of the injection, to the temperature of combustion of the oil in the formation. Then, in a combustion stage, the injection of steam is continued and stimultaneously an oxygen-containing gas is injected to cause combustion of oil adjacent to the site of injection thereby causing a further rise in temperature, further heating the steam, forming gases including carbon dioxide, carbon monoxide and more steam, increasing the mobility of the oil, and increasing the pressure within the formation. Appropriate equipment is employed and precautions observed to take care of the hazards and corrosive effect usually associated with oxygen, as will be apparent from the detailed description to follow.

In a cyclic stimulation method, there will be a cycle of combustion stages, each intervened by a soaking stage, in which the reservoir is shut-in and oil is recovered at the end of the final soaking stage.

Where a combination of steam flooding and forward combustion is employed, the oil will be driven towards a production well or wells at a site in the reservoir remote from the site of injection.

The steam employed may be saturated steam of quality from 70 to 80% or superheated steam. In accordance with one aspect of the invention, the superheated steam is formed by feeding saturated steam or water into a reactor chamber containing a catalyst along with a carbonaceous fuel and an oxygen-containing gas, whereby high temperature combustion occurs, resulting in the formation of heat, carbon dioxide and water and causing heat generated to increase the quality of the steam, for example, to turn the saturated steam into superheated steam.

Desirably, an oxygen-containing gas containing at least 90% oxygen is employed. The ratio of oxygen to steam may be from 1% to 50% contained oxygen by weight, preferably 2% to 10%. Desirably, the oxygen is added in increments of increasing magnitude so that the temperature in the formation is gradually raised.

The oxygen may be conducted downhole separately from the steam and injected separately into the formation to mix in the reservoir. Alternatively, the oxygen may be conducted downhole separately from the steam to a downhole mixing zone where the steam and oxygen are mixed together and the resulting mixture injected into the reservoir.

According to another aspect of the invention, the injection of both steam and oxygen is carried out through a conventional tubing string of carbon steel leading from the surface of the reservoir. The steam and oxygen are injected in alternative increments. A corrosion inhibitor may be added to protect the inside surface of the tubing string and an inert gas is injected through the tubing string after each steam increment to dry it out in preparation for the following oxygen increment.

The invention also contemplates an installation for carrying out the method.

An installation, according to the invention, is as follows. The installation includes a borehole extending from the surface to the oil reservoir. A casing extends within the borehole from the surface to the reservoir and has a head part and a foot part. Closure means at the head part and at the foot part seal off the annular space between the casing and the tubing string. The tubing string is provided with a gas outlet at the foot part. The foot part of the casing below the closure means has steam outlet openings. There are means for conveying steam from a source of steam supply under pressure to the annular space near the head part. There are means for supplying oxygen from a source of oxygen under pressure to the tubing string near the head part and there are means for controlling the steam supply and means for controlling the oxygen supply.

In one embodiment of the installation, the closure means sealing off the annular passage at the foot part is above the steam outlets in the foot part of the casing and the annular passage below it communicates directly with the inside of the casing. The tubing string outlet also communicates with the inside of the casing whereby the steam and oxygen are mixed downhole and the mixture is injected through the openings in the casing into the formation.

In an alternative form of installation, there are upper and lower sealing means respectively, closing the annular passage at the foot part, both above and below the outlets in the casing whereby the oxygen outlet is below the lower sealing means and steam and oxygen are injected separately into the formation.

In one embodiment, a source of steam supply is a generator having an elongated reaction chamber leading from an inlet end to an outlet end and containing a catalyst. The reaction chamber is provided, at the inlet end, with an inlet for saturated steam or water, an inlet for carbonaceous fuel and an inlet for oxygen. The outlet end is provided with an outlet for superheated steam generated.

Desirably, the installation is provided with control equipment whereby the flow of steam to the annular passage may be monitored and the flow of oxygen to the tubing string may be monitored so that these flows can be varied and the proportion of oxygen to steam may be regulated. Control apparatus involves an oxygen generation storage unit, and intervening the storage unit and the annular passage, a pumping vaporization unit, and a pressure reduction unit. There is a water supply unit, and intervening the water supply unit and said annular passage, there is a steam generator. A flow control monitoring device is provided for monitoring the flow of steam to an annular passage and a monitoring device is provided for monitoring the flow of oxygen to the tubing string.

There may be a gas storage unit for adding gas to the oxygen preferably between the pumping vaporization unit and the pressure reduction unit.

Having regard to the explosive nature of the oxygen-fuel mixtures and the corrosive effects of steam-oxygen mixtures, the applicants have developed special measures enabling the injection of the steam and oxygen into the formation to be carried out safely to avoid damage to the installation.

The invention has been generally described, and it will now be referred to in more detail by reference to the accompanying drawings, which illustrate preferred embodiments, and in which.

Figure 1:
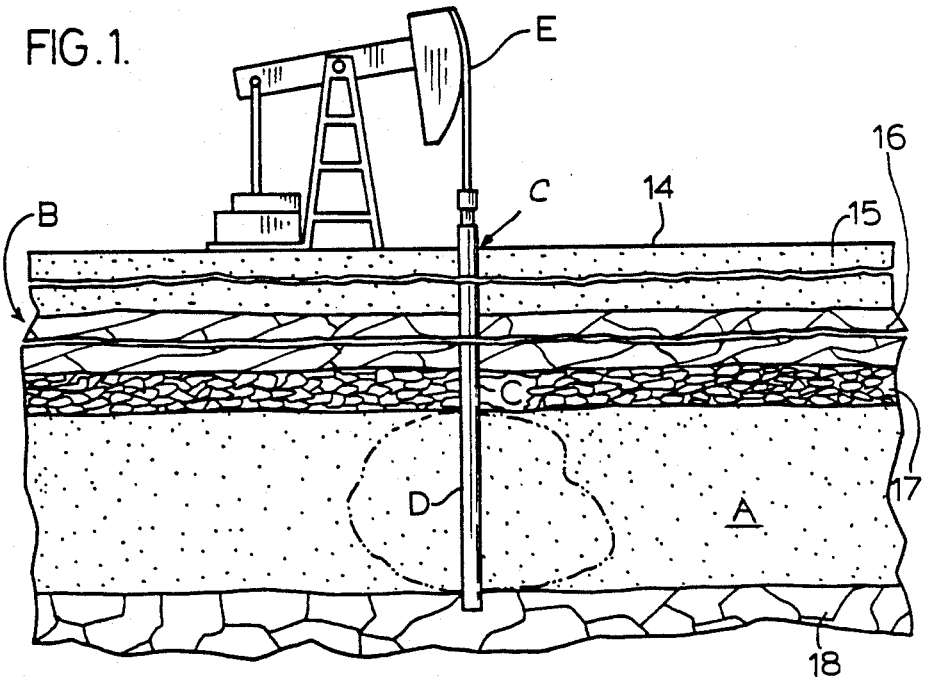
FIG. 1 is a diagrammatic illustration of a cyclic steam stimulation installation, to which the invention may be applied.

Referring more particularly to FIG. 1 of the drawings, the installation shown is essentially for carrying out cyclic steam stimulation, popularly known as the "huff and puff" method.

A heavy oil reservoir A is shown underlying several strata of overburden B including an upper strata 15, for example, soil, an intermediate strata 16, say, limestone, and 17, say shale. The reservoir overlies a shale or rock bed 18. The overburden has an upper surface 14. A well C extends from the surface 14 through the overburden B to the reservoir A.

A casing D extends down the well C to the reservoir A. The casing D has connections at the surface 14 with apparatus for supplying steam and oxygen-containing gas and water. The drawing is, of course, oversimplified and the dimensions distorted for the purpose of illustration the accompanying explanation, and the details of the equipment within the casing are omitted, but shown in subsequent figures.

Cyclic Steam Stimulation

In the case of cyclic steam stimulation, an oil pump E is provided at the surface for recovery of the oil produced.

In this process, high quality saturated or superheated steam is added to the well C until the formation around the well reaches a temperature effective to start high temperature combustion of the oil. This serves as a priming stage.

After the combustion temperature is reached, oxygen or an oxygen-containing gas mixture is added to the steam, in the tubing string, downhole of the tubing string, or directly into the formation, as will be described later in more detail.

The oxygen contacts some of the hot oil, in the formation, and combustion starts releasing heat and forming mainly $CO_2$, CO and water, and possibly some hydrogen and hydrocarbons. This heat serves to add more heat to the steam that moves through the formation warming the oil in its path.

The oil is reduced in viscosity, by this heating, and also by the dissolution of carbon dixoide formed in the resulting reactions. This results in increasing oil production when the well is placed on its oil production cycle. The effect of adding an oxygen-containing gas to steam is also to increase the pressure in the formation, so that when the well is placed on production, the pressure drop is increased to produce oil at a faster rate than would otherwise be the case.

The steam-oxygen-gas mixture may be added for a period of several days of weeks before it is stopped and the well is shut in. The shut-in period may last for several days or weeks during which time the heat "soaks" into the formation. After this phase, the well is returned to production.

This cycle ma be repeated several times and stopped when the ratio of the injected steam is recovered oil is too high.

Steam Flooding

Figure 2:
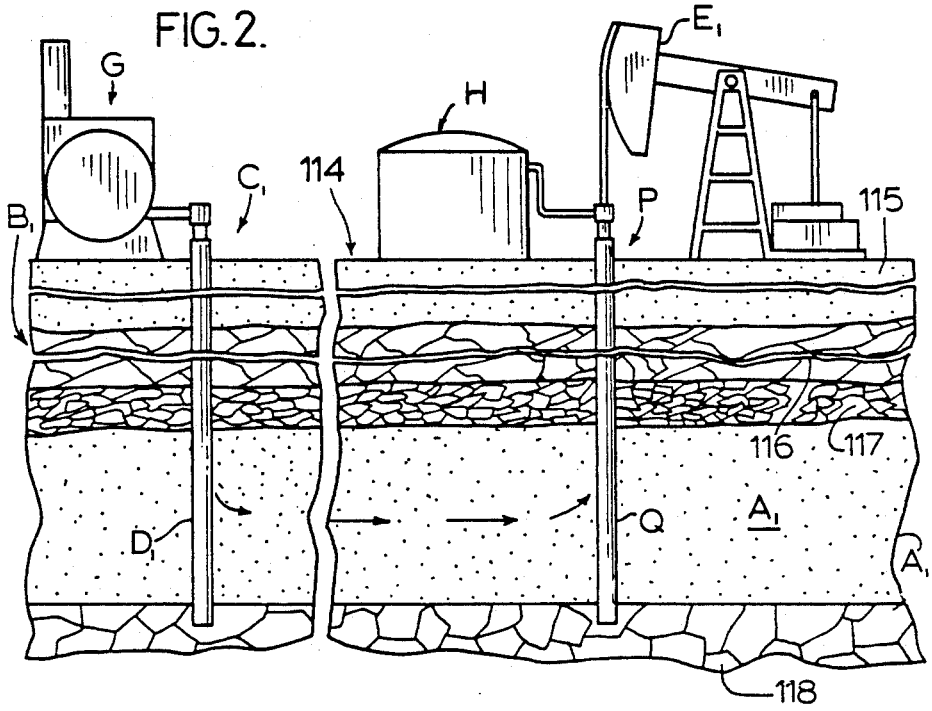
FIG. 2 is a diagrammatic illustration of a steam flooding installation, to which the invention may be applied.

FIG. 2 shows a steam flooding installation, modified in accordance with the invention.

A heavy oil reservoir $A_1$ is shown underlying several strata of overburden $B_1$ including an upper strata 115 and intermediate strate 116 and 117 overlying a bed 118. The overburden has a surface 114. An injection well $C_1$ extends from the surface through the overburden.

A casing $D_1$ extends down the injection well $C_1$ to the reservoir $A_1$. The casing $D_1$ has connections at the surface 114 with apparatus G for supplying steam. Provisions for adding oxygen, gas and water into the reservoir through the injection string $D_1$ is also provided, although not illustrated in FIG. 2.

At the surface there is a supply apparatus G for oxygen-containing gas, a steam generator, and several tanks H for production fluids.

Spaced laterally from the injection well $C_1$ is a production well P which also extends from the surface through the overburden $B_1$ to the reservoir $A_1$. A casing Q enclosing apparatus for conveying oil and vent gases, respectively, extends down the producer well P from the surface of the reservoir. A pump $E_1$ is provided at the top of the well.

While only one production well is shown, it is understood that in a typical steam flooding installation, there are usually several production wells spaced from and surrounding the injection well.

Steam is injected into the injection well $C_1$ until the formation in the vicinity of the well is preheated to a temperature close to that of the steam and above the ignition temperature of the oil in the reservoir. This is the priming stage.

Oxygen or an oxygen-containing gas mixture is then added to the steam, in the tubing string, downhole of the tubing string, or in the formation in a combustion stage.

The oxygen reacts with the oil, in the preheated formation, resulting in high temperature combustion. The combustion releases heat and forms mainly $CO_2$, CO and water in the form of steam and possibly some hydrogen and some hydrocarbons. The heat reduces the oils' viscosity. The gases formed, which are not dissolved in the oil increase the pressure and push the oil towards the producer well or wells P. Also, carbon dioxide, resulting from the combustion, dissolves in the oil, assists in further decreasing the viscosity and making it swell.

At the producer well P, the oil is pumped out along with some water and the combustion gases are vented to the atmosphere. With appropriate control of the process, there will be substantially no release of oxygen in the vent gases because the high temperature combustion reaction consumes most of the oxygen.

When saturated steam and oxygen are injected into the formation, according to the invention, the heat generated by combustion of the oil will result in adding heat to the steam. The heated steam will then move through the formation in advance of the combustion, thus heating the oil ahead of it.

The combustion front will move outwards into the formation and the temperature will increase as the combustion front advances and will come in contact and react with some of the oil and fuel that is not pushed ahead by the steam. The temperature rise of the formation will depend on how much oxygen is added to the steam. A burned out zone will be left between the injector and the combustion front if sufficient oxygen is available.

Process control is effected by monitoring the pressure and temperature downhole with appropriate instrumentation and by monitoring the composition of the exhaust gases and the temperature of the oil at the producer well.

Good combustion will be shown by a predominance of carbon dioxide, carbon monoxide and hydrogen at the producer well but little or no oxygen in the gases coming off the production well. Poor combustion will result in significant amounts of oxygen appearing in those gases. In the latter case, the process may be regulated by reducing the oxygen and preheating the oil by continued steam injection and then resuming oxygen injection along with the steam.

Quality of Steam

The steam used in either cyclic steam stimulation, or steam drive processes, is normally saturated steam of quality 70 to 80%. But it is preferable to use superheated steam because the heat content is higher and this will results in a higher addition of heat to the formation.

Figures 3, 7:
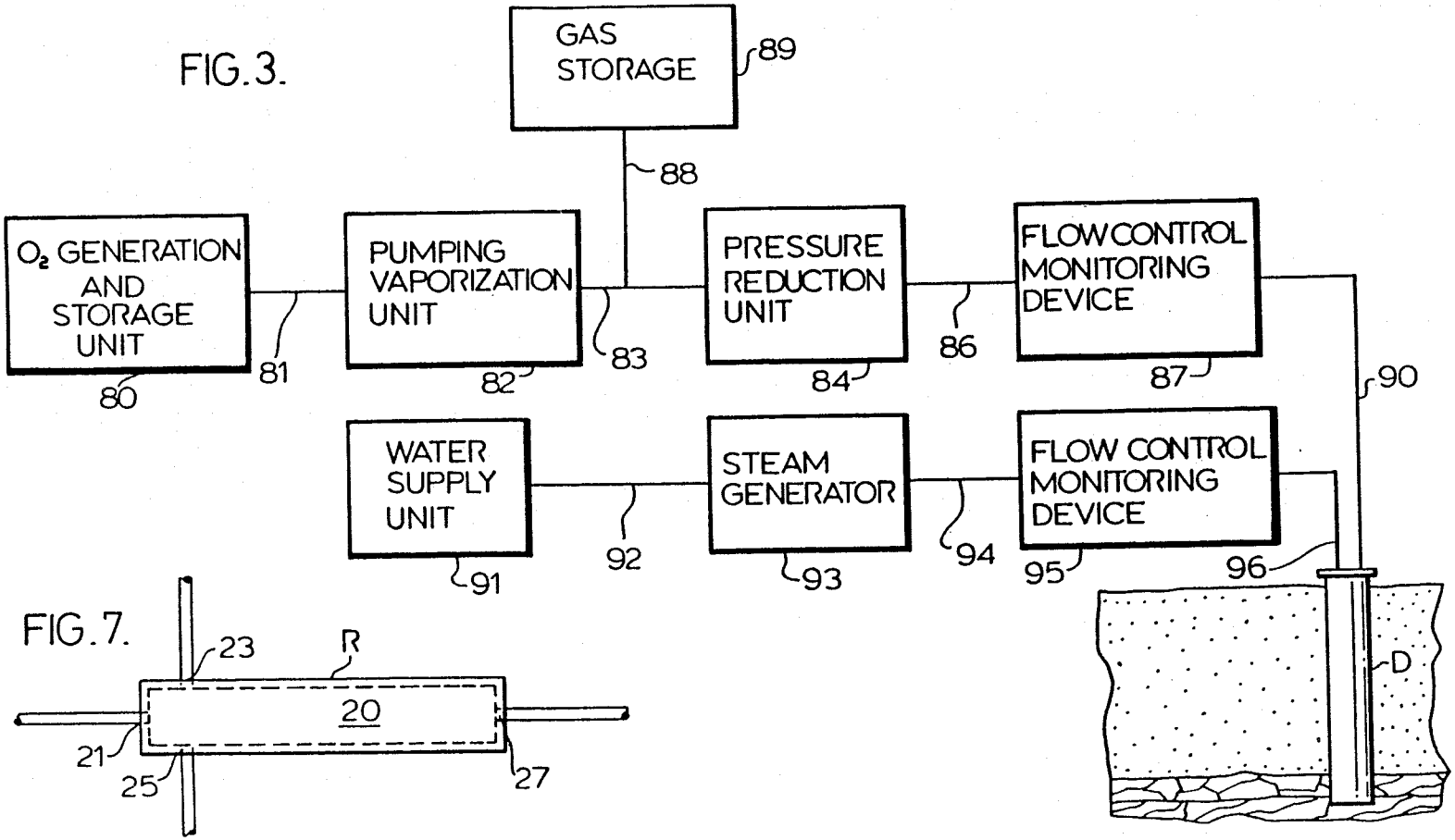
FIG. 3 is a block diagram showing apparatus for supplying oxygen, auxiliary gas, steam and for controlling their supply.
FIG. 7 (which appears on the sheet containing FIG. 3) is a diagrammatic illustration of a tubular reactor to make superheated steam from saturated steam or water, according to one aspect of the invention.

Superheated steam is made from saturated steam by adding heat to it. One way of doing this, according to the invention, is to mix saturated steam with an oxygen-oil mixture that reacts in a combustion mode. Preferred apparatus for doing this is shown in FIG. 7.

This apparatus is made up of a tubular alloy steel reactor R packed with an inert medium 20. The reactor R has an inlet 21 for saturated steam or water, an inlet 23 for carbonaceous fuel, and another inlet 25 for oxygen. These inlets are all towards the end of the reactor. The reactor has an outlet 27 at the other end for superheated steam.

Saturated steam is fed to the reactor through the inlet 21. Oil and an excess of oxygen are added through the inlets 23 and 25. The oil is heated by the steam and reacts with the oxygen forming carbon dioxide and liberating heat. The heat liberated is transferred to the saturated steam and converts it to superheated steam. The degree of superheat obtained depends on how much oil is added, since oxygen is present in excess.

An alternative version of this apparatus may be equipped to make saturated steam and turn this into superheated steam. This can be done by feeding water to the reactor through the inlet 21 and crude oil through the inlet 23 so that saturated steam is first formed which is turned into superheated steam as it moves along the reactor. Crude oil may be used as the fuel, but other carbonaceous fuels or hydrogen may be used. The oxidant may be oxygen or a oxygen-containing gas of the characteristics to be described.

An example of the use of such an apparatus in supplying superheated steam to the process is as follows.

Example of Application

Consider production of 100 Bbls/day of superheated steam at a pressure of 1000 psia and temperature of 600° F. starting from water at 60° F.

| | | |
|---|---|---|
| Enthalpy steam at 1000 psia and 600° F. | = | 1249 BTU/lb. |
| Enthalpy water at 14.7 psia and 60° F. | = | 60 BTU/lb. |
| Enthalpy required to produce | = | 1189 BTU/lb. superheated steam |
| 100 Bbls/day steam | = | 35,000 lbs/day |
| Enthalpy required | = | $35{,}000 \times 1189$ BTU/day |
| | = | $41.6 \times 10^6$ BTU/day |
| Assume heat liberated by oxidation of oil | = | 18,000 BTU/lb. |
| Then quantity of oil required | = | $\frac{41.6 \times 10^6}{18{,}000}$ lbs/day |
| | = | 2311 lbs/day |
| Then the total oxygen required, assuming 3.3 lbs. is required to combust 1 lb. oil | = | $3.3 \times 2311$ lbs/day |
| | = | 7627 lbs/day |
| Assume that oxygen is added to obtain a 30% oxygen-steam mixture by weight. | | |
| Then oxygen added | = | $35{,}000 \times \frac{30}{100}$ lbs/day |
| | = | 10,500 lbs/day |
| The total oxygen requirement | = | 7627 + 10,500 lbs/day |
| | = | 18,127 lbs/day |

Avoidance of Problems

Use of steam-oxygen mixture presents, as a main problem, the fact that these mixtures are highly corrosive and attack many metals. This is especially true if the steam contains chloride ions, or if the oxygen-steam mixture contacts chloride-containing water.

The invention provides means for overcoming this problem, by keeping the steam and oxygen separate until they enter the formation. This enables conventional oil field tubular equipment to be used for the wells.

One of the expedients is to add the steam and oxygen in separate slugs so that they do not mix together until they are in the formation.

One procedure for doing this is as follows. First, steam is added to the conventional tubing string of carbon steel and enters the formation. This addition may continue for several days and weeks. The steam addition is followed by adding a corrosion inhibitor. This inhibitor may be carried in the steam, or may be added as a solution, but a sufficient quantity must be present to protect the inside of the tubular string and the couplings where joints are made. A slug of nitrogen gas is then passed through the tubing to dry it out. Oxygen gas is then added for a period of several days or weeks, whereby it enters the formation and mixes with the previously injected steam. Nitrogen gas is then added to flush out oxygen before further steam is added to push the oxygen in the formation and the cycle continues.

This procedure can be used for cyclic steam stimulation or steam drive. In the case of cyclic steam stimulation, the steps may be repeated several times before the well is shut in and the heat is allowed to soak in, followed by production of oil. After production of oil is completed, the resumption of the cycle should proceed as in the first cycle. After the steam addition, the tubing will be oil free to safely accommodate the addition of oxygen.

Addition of Oxygen to Steam in the Formation

Figure 4:
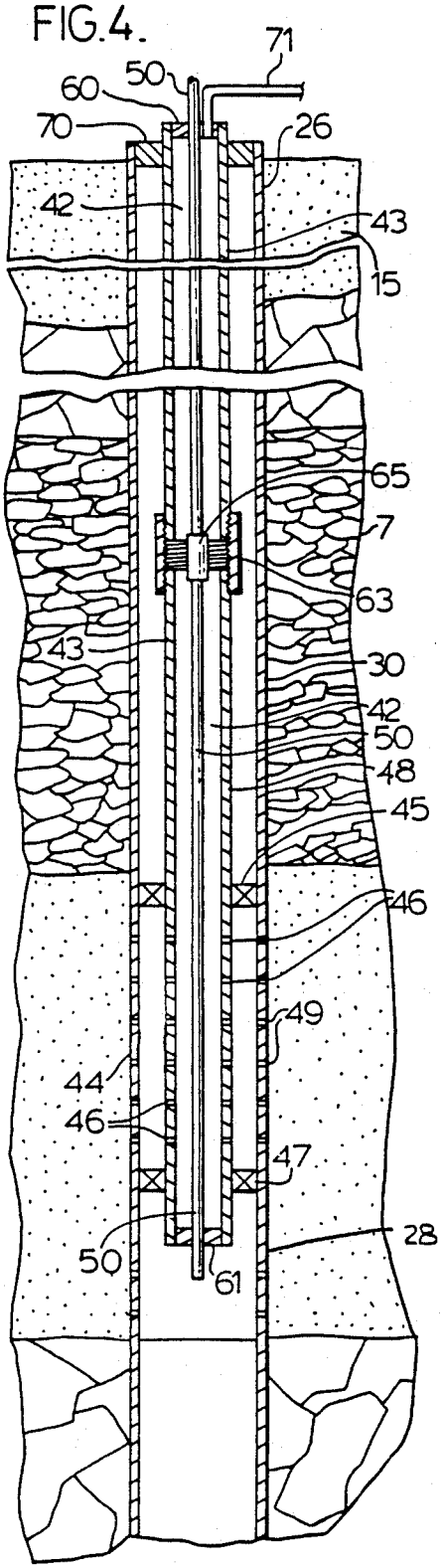
FIG. 4 is a vertical cross-section through an oil bearing formation showing, partly in elevation, an installation for mixing oxygen and steam in the formation.

Illustrated in FIG. 4 is an installation in which the steam and oxygen are kept apart until they mix together in the formation. This arrangement may be employed either in the cyclic steam injection process or steam flooding process. It may be applied to existing or newly designed wells.

The following illustrates a typical preferred installation. The casing 30 of the well extends from a head part 26, at the surface, to a foot part 28 below the formation 7. The foot part 28 is provided with perforations 49.

The casing 30 for most of its length may be of carbon steel. The outside of the casing is sheathed in cement. A section 44, at the foot part, is made of alloy steel for a length up to, say, 3 meters above the top of the perforations.

The top of casing 30 is enclosed by well head assembly including a plug 70 at the head of the casing having an opening to accommodate the tubing string 43.

The tubing string 43 is hung in the well and sealed against the liner, using spaced-apart packers 45 and 47. Each packer has a bearing part of an elastomer that will allow vertical movement between the casing and tubing for expansion and contraction.

Inside the tubing string 43, there is installed continuous tubing 50 which extends all the way from top to bottom. A plug 60 forming part of the well head assembly is provided at the head end of tubing string 43, and the plug 60 has an opening accommodating the tubing 50. Likewise, a plug 61 is provided at the foot of the tubing string accommodating the tubing 50. The tubing 50 starts above the plug 60 and projects below the plug 61. The tubing string 43 and continuous tubing 50 provide between them an annular steam passage 42.

The tubing string is made up of lengths of tube joined by connecting pieces 63. The lengths of tubing 50 are connected by joints such as the joint 65.

The materials of construction may be carbon steel for the tubing string 43, except for the lower part 48, where alloy steel is used. The part 48 is provided with outlet openings 46. The packers 45 and 47 are of a known type made of alloy steel and an elastomer able to withstand temperatures up to 300° C. in an oxygen-steam atmosphere.

Operation

In operation, steam is added through the line 71 at the head of the annulus 42. Steam escapes, from the annulus 42, into the formation through the perforations 46 in the tubing string and the perforations 49 in the casing. The perforated section of the tubing string is between the packers 45 and 47 so the steam is injected through the casing perforations 49 above the packer 47 and hence directly into the formation from this section. The oxygen, on the other hand, is added to the continuous tubing 50, at the head end, and escapes through the foot of the continuous tubing 50 below the end of the tubing string and below the packer 47, and is injected directly into the formation through the perforations 49 in the perforated section of the casing, below the packer 47. In this way, the steam and oxygen are kept apart until each enters separately into the formation where they mix together.

Figure 5:
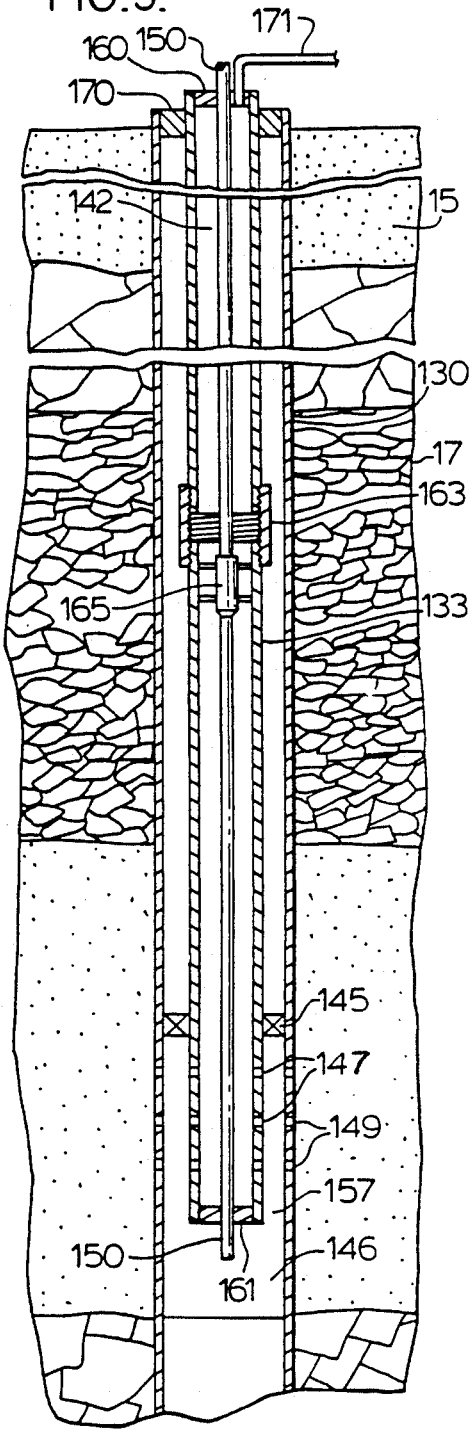
FIG. 5 is a vertical cross-section through an oil bearing formation showing, partly in elevation, an installation for mixing oxygen and steam downhole of the bore well.

FIG. 5 illustrates an installation for mixing oxygen and steam downhole of the bore well. For simplicity, similar reference numerals as in FIG. 4 apply to similar parts, except that they have been raised by 100.

The fundamental structure of the casing 130, the tubing string 133 and the tubing 150, etc. are similar. In this installation, however, the structure is such that the steam and oxygen are kept apart only until the bottom of the well (downhole) where they mix together before entering the formation.

In this construction, there is a single packer 145 between the tubing string 133 and the casing, and the casing extends to a sump 146, thus forming within the casing a chamber for mixing the steam and oxygen. The tubing string below the packer 145 is provided with openings 147 to allow the lateral escape of steam from the tubing string into the chamber 157.

The continuous tubing 150 continues beyond the plug 161 and has an outlet within the chamber 157.

Steam is added at the head of the tubing 133 and passes down the annular passage between it and the continuous tubing 150 out through the openings 149 into the sump 146. Oxygen is fed to the top of the continuous tubing 150 and passes out through the bottom of the tubing 150. The oxygen and the steam are thus mixed together in the chamber 157 and the mixture is then injected into the formation through the holes 149 in the casing.

Process Control

The recovery of oil according to the best advantage requires effective process control. FIG. 3 is a block diagram illustrating the control of the various phases of the process.

Oxygen is fed from an oxygen generation and storage unit 80, through a supply line 81, to a pumping vaporization unit 82. From the unit 82, the oxygen passes through a line 83 to and through a pressure reduction unit 84 and then through a line 86 to a flow control monitoring device 87.

The line 83 is joined by a line 88 leading from a source 89 of storage for gas. In the monitoring device, the gas flows under pressure into the line 90 which leads to the continuous tubing 50 or 150, in the injection well.

Steam is supplied as follows. Water, suitably treated for steam generation, passes from a water supply 91 through a line 92 to a steam generator 93. Steam passes from the generator 93 through a line 94 to a control monitoring device 95. From the device 95, the steam passes into the steam passage in the well, for example, the passage 42 or 142. See FIGS. 4 and 5.

Appropriate valves and other control devices are employed, in the control system, so that the supply of steam, oxygen, diluent gas, etc., can be regulated to exert process control.

Figure 6:
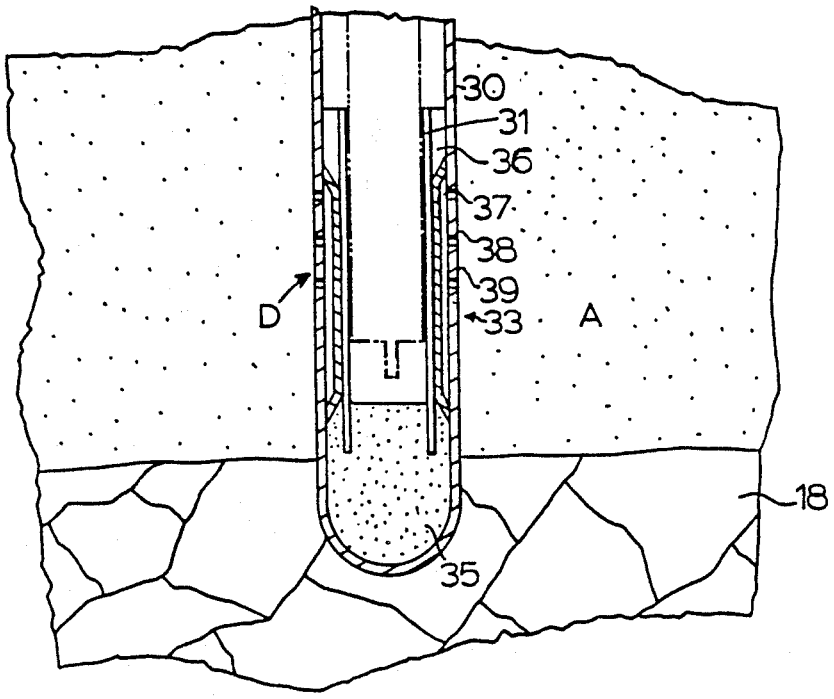
FIG. 6 is a cross-section through the lower part of a casing specially reconstructed, from one previously used for steam, for injecting steam and oxygen, according to the invention.

FIG. 6 illustrates the convertion of a well which has already been used for steam injection to one capable of being used with steam and oxygen, according to the invention.

The downhole end part of a used existing type of conventional carbon steel casing 30 is shown reconstructed for use in the present invention. This casing has perforations from its previous use, to allow steam to escape into the formation, or, to allow the ingress of oil and gas in a producer well.

A heavy wall section of liner 31 of non-corrosive material, for example, stainless steel, is located inside and spaced somewhat from the casing 30. A thermal cement plug 35 closes the foot of the casing 30 and embeds the lower end of the liner 31. A lead sleeve 37, of the shape shown, but preferably solid with tapered shoulders at top and bottom encloses the liner 31 and extends between the casing 30 and the liner 31. The cement plug 35 holds the liner 31 in place and seals the lower end of the lead sleeve 37 against the casing 30. A cement ring 36, between the casing 30 and the shoulder of the liner 31 seals the upper end of the lead sleeve 37 against the casing 30.

When the casing with the lining structure described is placed downhole, new outlet openings 49 (FIG. 4) are made through the stainless steel liner 31, the lead sleeve 37, and the carbon steel casing 30. This may be done by remote control using an explosive perforating device, so that the new perforations may or may not register with the original perforations in the casing.

As shown in FIGS. 4 and 5, the lower end of the tubing string 33 (133) and the tubing 50 (150) enters the space inside the corrosion resistant liner 31.

Where the device is to be used for mixing steam and oxygen downhole and the mixture injected, a single packer above the perforations is employed, as shown in FIG. 5. If the device is to be used for injecting the steam and oxygen separately, a packer will be needed above the openings and another packer near the foot of the tubing string as shown in FIG. 4.

Variable Factors

Steam

Steam is supplied at the head of the injector well as saturated steam for quality 70–80% or preferably superheated steam, whose higher heat content will be advantageous in making the formation more rapidly.

Oxygen-Containing Gas

The oxygen-containing gas may be commercial oxygen having a content of at least 90% by volume (percent by mol), according to standard measurements, or a mixture of oxygen and a diluent gas. Suitable diluent gases are, for example, nitrogen, carbon dioxide, carbon monoxide, and vent gases resulting from oil production. The oxygen content of the oxygen-diluent gas mixture should be at least 90% by volume under standard conditions.

Process Conditions

In starting up the process, high quality saturated steam or superheated steam is injected into the formation, in an ignition stage, until the temperature is raised to within the combustion temperature range of the oil in the formation. The temperature around the injection zone will usually be from about 200° to about 250° C., and the temperature further out in the formation will be lower.

Then, in the combustion stage, a gas containing at least 90% (by volume) of oxygen is injected along with the steam to provide a ratio from about 5% to 100% by weight of oxygen to steam. Preferably, a relatively low proportion of oxygen to steam is added, at the outset, and this is increased periodically by increments of preferably 5% to 10%, say, every week or so, where the combustion stage lasts several months. The addition of the oxygen-containing gas will produce a rise in temperature around the injection zone beyond that of the ignition stage. The combustion stage will, therefore, be conducted at temperatures above the ignition temperature of the oil, preferably above 200° C.

The embodiments of the invention in which an exclusive property or privilege is claimed are defined as follows:

1. A method of recovering oil from an underground formation, comprising carrying out a priming stage by injecting steam into the formation until the temperature within the formation near the site of the injection reaches the temperature of combustion of the oil, then carrying out a combustion stage by injecting the steam and oxygen-containing gas in alternative increments, said injecting of steam and oxygen-containing gas being carried out through a conventional tubing string of carbon steel leading from the surface of the reservoir and causing combustion of oil adjacent to the site of injection, thereby causing a further rise in temperature, further heating the steam, forming gases including carbon dioxide, carbon monoxide and more steam, increasing the mobility of the oil, and increasing the pressure within the formation, injecting an inert gas through the tubing string after each steam increment to dry it out in preparation for the following oxygen-containing gas increment.

2. A method, as defined in claim 1, in which cyclic stimulation is employed and there is a cycle of said combustion stages each intervened by a soaking stage in which the reservoir is shut-in, oil being recovered at the end of the final soaking stage.

3. A method, as defined in claim 1, in which the combustion stage is carried out by a combination of steam flooding and forward combustion and the oil is recovered at a site in the reservoir remote from the site of injection.

4. A method, as defined in claim 1, in which the steam employed is saturated steam of quality from 70 to 80%.

5. A method, as defined in claim 1, in which the steam employed is superheated.

6. A method, as defined in claim 5, in which the superheated steam is formed by feeding saturated steam or water into a reactor chamber containing a catalyst along with a carbonaceous fuel and an oxygen-containing gas, whereby high temperature combustion occurs resulting in the formation of heat, carbon dioxide and water and causing the heat generated to turn the saturated steam into superheated steam.

7. A method, as defined in claim 1, in which the oxygen-containing gas contains at least 90% oxygen.

8. A method, as defined in claim 1, wherein the injection of steam and oxygen-containing gas results in an oxygen-steam mixture, the molecular oxygen content in said oxygen-steam mixture being from 1% to 50% by weight.

9. A method, as defined in claim 1, in which the oxygen-containing gas is conducted separately from the steam and injected separately into the formation to mix in the reservoir.

10. A method, as defined in claim 1, in which the oxygen-containing gas is conducted separately from the steam to a downhole mixing zone where steam and oxygen are mixed together and the resulting mixture is injected into the reservoir.

11. A device for injecting steam and oxygen into a formation, comprising, a cylindrical casing of corrodable steel having a lower part provided with perforations as steam outlets or oil and gas inlets, a corrosive resistant cylindrical liner within said lower part having a wall spaced inward from the casing in the area containing the perforations a lead sleeve having a part surrounding the corrosive resistant liner to block off the perforations, a thermal cement plug filling the lower end of the casing and embedding the bottom of the corrosive resistant liner and sealing the bottom of the lead liner against the casing, and cement sealing the top of the lead liner against the casing.

* * * * *